United States Patent [19]

Cameron et al.

[11] Patent Number: 5,001,836

[45] Date of Patent: Mar. 26, 1991

[54] APPARATUS FOR BORESIGHTING A FIREARM

[75] Inventors: Jeffrey A. Cameron, Decatur; Deborah L. Fraley, Madison, both of Ala.

[73] Assignee: Camtronics, Inc., Madison, Ala.

[21] Appl. No.: 475,721

[22] Filed: Feb. 5, 1990

[51] Int. Cl.[5] ..... F41G 1/54; G01B 11/26

[52] U.S. Cl. ..... 33/234

[58] Field of Search ..... 33/234, 235, 227, 228, 33/645, 533; 356/138, 140, 153

[56] References Cited

U.S. PATENT DOCUMENTS

| | | | |
|---|---|---|---|
| 3,782,832 | 1/1974 | Hacskaylo | 33/234 X |
| 4,136,956 | 1/1979 | Eichweber | 356/153 |
| 4,530,162 | 7/1985 | Forrest et al. | 33/234 X |
| 4,879,814 | 11/1989 | Wallace | 33/234 |

*Primary Examiner*—Harry N. Haroian

*Attorney, Agent, or Firm*—Phillips & Beumer

[57] ABSTRACT

Apparatus for boresighting a firearm which utilizes a source of light such as a laser transmitter. A light-receiving and directing device carried on the bore directs a light ray along the axis of the bore of the firearm to a target. An optical sight carried on the firearm is adjusted in azimuth and elevation to be in alignment with the light ray as it reaches the target. The source of light is remotely located from the bore of the firearm.

13 Claims, 2 Drawing Sheets

APPARATUS FOR BORESIGHTING A FIREARM

TECHNICAL FIELD

This invention relates to a device for boresighting firearms and more particularly to such devices utilizing light beams.

BACKGROUND OF THE INVENTION

The prior art includes numerous types of devices for aligning a gun sight in accurate relation with the gun bore. Light-emitting devices have been used which direct a beam of light through the bore of the firearm onto a target so that the bore can be aligned with the target. One such light-emitting alignment device is disclosed in U.S. Pat. No. 4,530,162, issued July 23, 1985 to Forrest et al., wherein a light-generating device is rigidly secured to the chamber end of a rifle, and a muzzle assembly is mounted in the muzzle end of the barrel. The light is directed through a first tubular extension where it is reflected by a 45-degree mirror which is mounted in a chamber elbow into a second tubular extension which is mounted in the gun barrel. The chamber elbow must be precision machined to be snugly fitted into the chamber and both of the extensions must have accurately machined bores therethrough for alignment with perpendicular bores in the chamber elbow. It is also apparent that attachment means must be provided for securing the assembly in the receiver.

Another type of boresighting method that uses light-emitting devices is disclosed in U.S. Pat. No. 3,782,832, issued Jan. 1, 1974, to Hacskaylo. In this patent, an aiming light is mounted in a boresight mechanism which is mounted to the weapon. A light source is secured in a canister, and the canister is mounted in the breech of the firearm. The operator aligns and positions the aiming light with respect to the boresight light beam. A head-worn viewing scope is used by the operator to observe the positions of the boresight light and the aiming light that is reflected off a target.

SUMMARY OF THE INVENTION

The present invention relates to an improved type of gun alignment device using a collimated beam of light which is directed to a target by a light-directing device which is mounted within the firearm bore. The light source is disposed remotely from the firearm.

It is an object of the present invention to provide a boresight system for a firearm which uses a light-emitting device for illuminating a target.

It is another object of the present invention to provide such a boresighting device in which the light-emitting device is remotely located from the firearm.

It is a further object of the present invention to provide such a boresighting device with light-receiving and directing means which is disposed for receiving the light from the emitting device and for directing a light ray along the longitudinal axis of the bore of the firearm to a target.

DESCRIPTION OF THE PREFERRED EMBODIMENT

Figure 1:
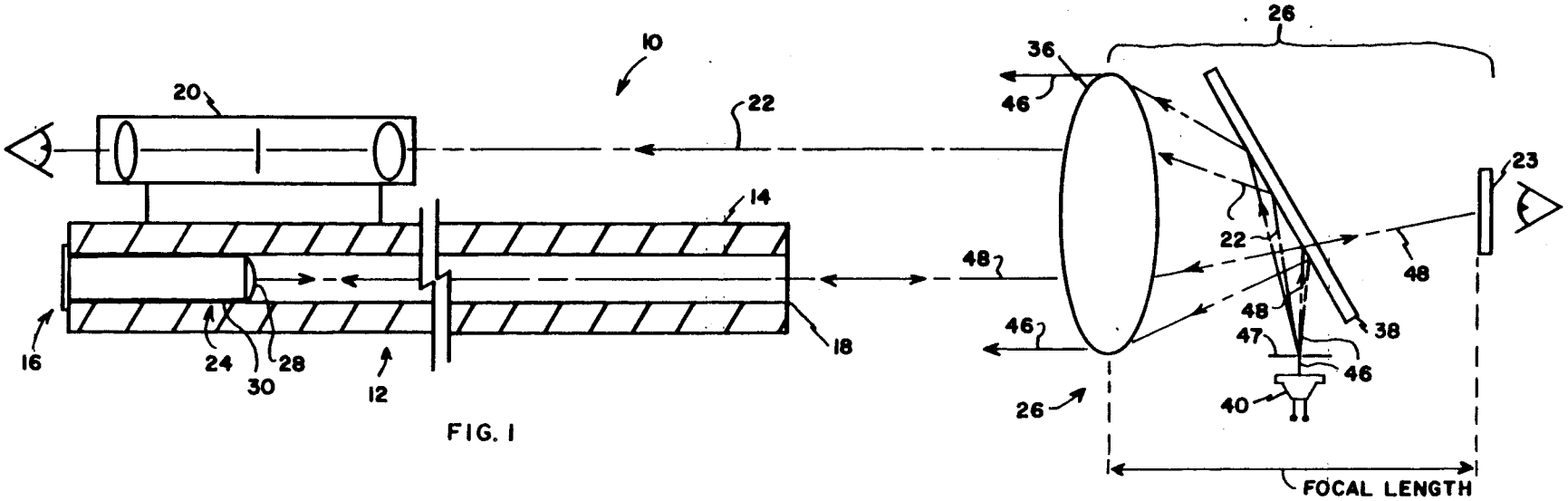
FIG. 1 is a diagrammatic view of an embodiment of the boresighting apparatus of the present invention.
Figure 6:
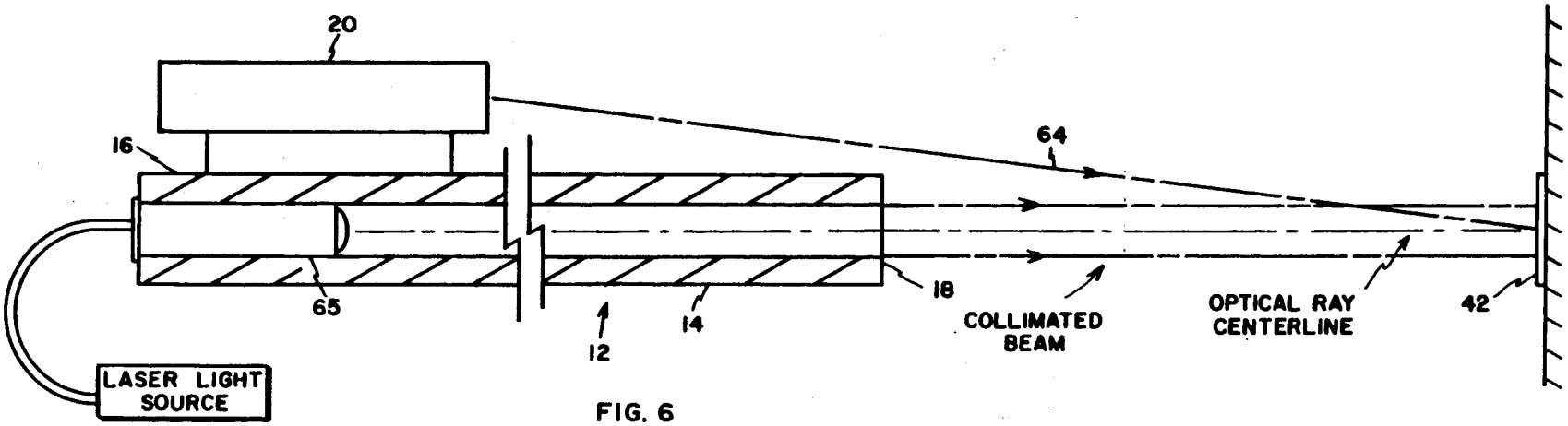
FIG. 6 is a diagrammatic view of another embodiment of the present invention.

A boresighting apparatus 10 constructed in accordance with the principles of the present invention is illustrated in FIGS. 1 and 6. The boresighting apparatus may be used in conjunction with a firearm 12 which may be a rifle or any of many other types of firearms. As seen in FIG. 1, firearm 12 includes a barrel 14 having a rear (chamber) end 16 and a muzzle end 18. An optic sight (scope) 20 is adjustably set to view a target reticle 41 along a line-of-sight axis 22.

The boresighting system of the embodiment of FIG. 1 includes a light-reflecting device or member 24 adapted for insertion into barrel 14 and a collimating system 26. Light-reflecting member 24 includes a reflective surface 28 at the forward end 30 thereof. Member 24 may be a bullet casing or canister which snugly fits in the bore of the barrel chamber.

Figure 4:
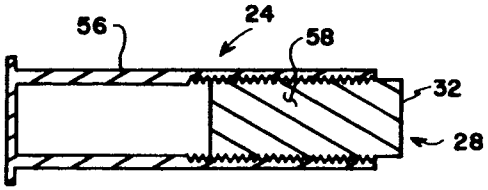
FIG. 4 is a sectional view of a bullet casing having a mirror reflector member mounted therein. The casing is mountable in the barrel of the firearm for reflecting light therethrough.
Figure 5:
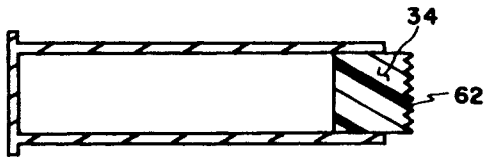
FIG. 5 is a view similar to FIG. 4 but illustrating the bullet casing as housing a retroreflector.

In FIG. 4, member 24 is shown to be a bullet/slug combination having a high precision diamond-turned surface 32 and in FIG. 5, member 24 is shown to be a bullet/retroreflector combination having a retroreflector member 34 mounted in a casing.

Collimating system 26 includes a collimator such as lens 36, a beam splitter 38, an optical reference source 40, a target reticle 41 and an alignment target 23. Lens 36 is positioned intermediate to the muzzle 18 of the barrel 14 and the beam splitter 38 which is positioned between alignment target 23 and lens 36. Alignment target 23 and target reticle 41 are positioned at the focal length of lens 36.

Figure 2:
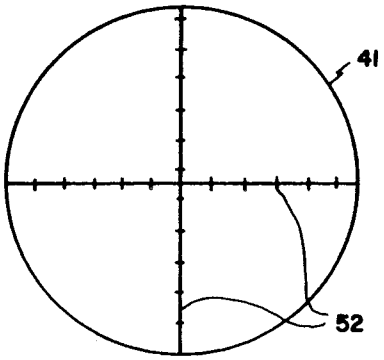
FIG. 2 is a diagrammatic view of a target reticle which may be used with the boresighting apparatus of the present invention.

The boresighting system of this embodiment (FIG. 1) allows the boresighting to be performed at infinity prior to adjustment of the LOS (line-of-sight) of the optical sight of the required range. To boresight the firearm, light rays 46 are directed from source 40 (which may be a laser transmitter) through a pin hole member 47 to beam splitter 38 and then to collimating lens 36, thus creating a collimated beam of light. As seen in FIG. 1, a ray 48 corresponding to the optical center line of firearm barrel 14 is directed through lens 36, into barrel 14, and onto surface 28 of member 24 where it is reflected back through the lens 36 and beam splitter 38. Ray 48 passes through beam splitter 38 and onto alignment target 23. The collimator or firearm is mechanically adjusted in azimuth and elevation such that the reflected image of the optical reference source is observed to coincide with the center of the alignment target and hence the optical center line of the collimator. The target reticle is then observed through the optical sight on the firearm, and the optical sight is adjusted so that the cross hair (not shown) in the optical sight corresponds to the appropriate graduation 52 on the target reticle (FIG. 2). This is related to the type of caliber, bullet weight, grain size, windage, and range required. Such data is obtainable from ballistic charts.

FIG. 2 is a diagrammatic view of a target reticle which may be used in the boresighting operation. As seen in FIG. 2, target 41 includes graduations 52 which are related to the adjustment increments (not shown) on the optical scope 20. Typically, such graduations are based on the bullet drop at a specific distance (such as one inch bullet drop at 100 yards).

Figure 3:
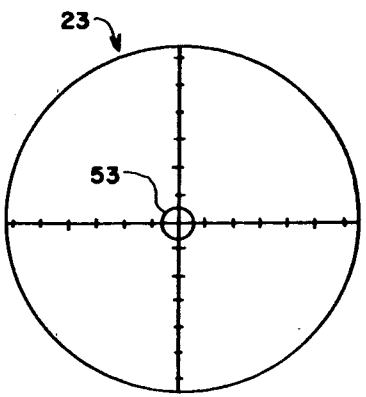
FIG. 3 is a diagrammatic view of an alignment target which may be used with the boresighting apparatus of the present invention.

FIG. 3 is similar to FIG. 2; however, there is an alignment circle 53 in place of graduations 52 so that an observer may align the light directed from surface 28 in circle 53. As seen in FIG. 1, the light from surface 28 originates at light source 40.

FIG. 4 illustrates the reflective member 24 as being a bullet case 56 which has been tapped and threaded to hold a slug 58 which is secured in the case by an epoxy adhesive, or the like. In this embodiment, the slug's forward reflective surface 28 has been diamond-turned to provide the mirrored surface 32. FIG. 5 is similar to FIG. 4; however, the internal surface need not be tapped and threaded, and a member 34 is secured at the forward end of the bullet casing by epoxy adhesive or the like. Member 34 is a retroreflector having a retroreflector surface 62 thereon.

FIG. 6 illustrates another embodiment of a boresighting apparatus. In the embodiment shown in FIG. 6, firearm 12 includes barrel 14 having a rear end (chamber) 16 and a muzzle 18. Optical scope 20 is shown to be mounted on barrel 14. A target reticle 42 is shown down range a predetermined distance from the firearm and the line-of-sight between the scope 20 and target 42 is indicated by the numeral 64. A bullet/lens combination member 65 is shown to be mounted in the barrel 14.

Figure 7:
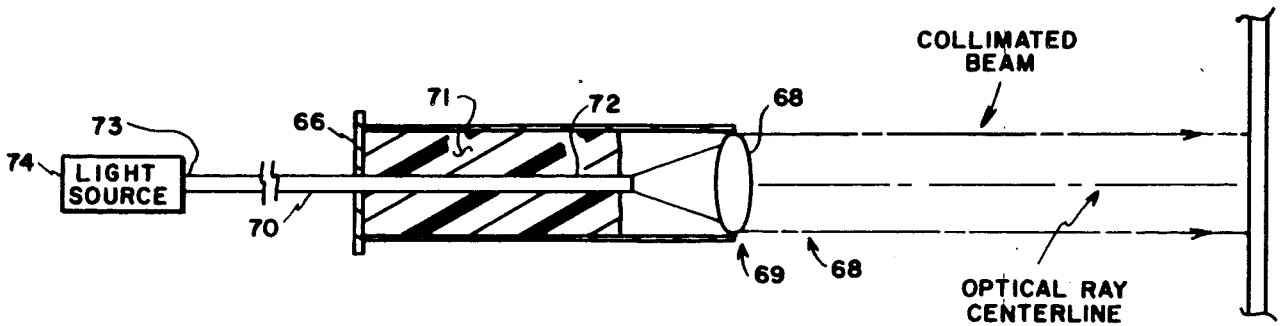
FIG. 7 is a diagrammatic view, partially in section, of a light-directing member mountable in the firearm of the embodiment of FIG. 6.

Bullet/lens member 65 includes a casing 66 (FIG. 7) disposed for snugly fitting in the barrel 14. A lens 68 is secured in casing 66 by epoxy adhesive, or the like, at the forward end 69 thereof. A fiber optic element 70 is also secured in the casing (as by epoxy adhesive 71, etc.) and has one end 72 terminating at the focal point of lens 68 and the second end 73 terminating at a light source 74 (such as a laser diode, for example).

In operation, the fiber optic delivers optical radiation to the bullet/lens 65 which is snugly and firmly held in the barrel. The lens 68 collimates the optical radiation towards the target. A specific range is marked off, and the optical sight is then adjusted to match or coincide with a spot on the target. The system is then boresighted at that range.

What is claimed is:

1. Apparatus for boresighting a device for accurate alignment of the axis thereof with a target means comprising:

a source of light remotely disposed from said device and disposed for generating light rays;

light receiving and directing means including a member carried in said device in alignment with the axis thereof, said member having a reflective surface carried thereon;

beam splitter means for directing a first portion of said light rays from said light source along a first path to said target means and a second portion of said light rays from said light source along a second path for incident relation with said reflective member for reflection therefrom back to said target for coincident relation thereon with said first portion of said light rays responsive to proper alignment of said device with said target means; and collimating means disposed intermediate said reflective surface and said beam splitter for collimating said light rays directed to and reflected from said reflected surface.

2. Apparatus as in claim 1 including an optical sight mechanism carried on said device in spaced relation with said member, said optical sight disposed for adjustment for coincident relation with the line-of-sight thereof and a spot formed by the light from said light source at the point of impingement thereof with a predetermined point on said target means.

3. Apparatus as set forth in claim 1 wherein said light-receiving and directing member is a bullet casing having open and closed ends, said lens mounted at the open end of said casing.

4. Apparatus as set forth in claim 1 wherein said target means includes a target reticle disposed thereon.

5. Apparatus as set forth in claim 4 wherein said light-receiving and directing member is comprised of a casing enclosing a body having a forward reflecting surface.

6. Apparatus as set forth in claim 5 wherein said reflective surface is a diamond-turned surface.

7. Apparatus as set forth in claim 6 wherein said body is secured in said casing by an epoxy adhesive.

8. Apparatus as set forth in claim 7 wherein said light source is a laser-transmitting device.

9. Apparatus as set forth in claim 4 wherein said target means further includes an alignment target, said alignment target having a predetermined area thereon for visual alignment thereof with said point of reflection of said reflected light from said member.

10. Apparatus as set forth in claim 9 wherein said light-receiving and directing member is comprised of a casing enclosing a body having a forward reflecting surface.

11. Apparatus as set forth in claim 10 wherein said reflective surface is a diamond-turned surface.

12. Apparatus as set forth in claim 11 wherein said body is secured to said casing by an epoxy adhesive.

13. Apparatus as set forth in claim 12 wherein said light source is a laser-transmitting device.

* * * * *